US009969525B2

(12) United States Patent
Longaphie

(10) Patent No.: US 9,969,525 B2
(45) Date of Patent: May 15, 2018

(54) STAND FOR MACHINE COMPONENTS

(71) Applicant: Finning International Inc., Edmonton (CA)

(72) Inventor: Stephen Longaphie, Blackfalds (CA)

(73) Assignee: FINNING INTERNATIONAL INC., Edmonton, Alberta (CA)

( * ) Notice: Subject to any disclaimer, the term of this patent is extended or adjusted under 35 U.S.C. 154(b) by 98 days.

(21) Appl. No.: 13/935,858

(22) Filed: Jul. 5, 2013

(65) Prior Publication Data

US 2015/0008296 A1 Jan. 8, 2015

(30) Foreign Application Priority Data

Jul. 4, 2013 (CA) ..... 2820064

(51) Int. Cl.

| | |
|---|---|
| ***B65D 19/44*** | (2006.01) |
| ***B65D 85/68*** | (2006.01) |
| ***B65D 19/00*** | (2006.01) |
| ***E02F 3/96*** | (2006.01) |
| *E02F 3/76* | (2006.01) |

(52) U.S. Cl.

CPC ..... *B65D 19/44* (2013.01); *B65D 19/0004* (2013.01); *B65D 85/68* (2013.01); *E02F 3/968* (2013.01); *B65D 2519/00024* (2013.01); *B65D 2519/00059* (2013.01); *B65D 2519/00273* (2013.01); *B65D 2519/00293* (2013.01); *B65D 2519/00323* (2013.01); *B65D 2519/00333* (2013.01); *B65D 2519/00562* (2013.01); *B65D 2519/00572* (2013.01); *B65D 2519/00786* (2013.01); *B65D 2519/00815* (2013.01); *E02F 3/764* (2013.01); *Y10T 29/49819* (2015.01)

(58) Field of Classification Search

CPC ..... B65D 19/0004; B65D 19/44; E02F 3/968; E02F 3/764; Y10T 29/49819

USPC ..... 248/671, 675, 673, 678, 554

See application file for complete search history.

(56) References Cited

U.S. PATENT DOCUMENTS

| | | | | |
|---|---|---|---|---|
| 1,564,131 | A * | 12/1925 | Dunlap | 248/678 |
| 4,177,978 | A * | 12/1979 | Warsaw | 269/17 |
| 4,440,265 | A * | 4/1984 | Spagnoli | 182/129 |
| 4,804,162 | A * | 2/1989 | Rice | 248/671 |
| 6,502,292 | B1 | 1/2003 | Hartley | |
| 6,685,405 | B2 | 2/2004 | Ketchmark | |
| 6,793,458 | B2 * | 9/2004 | Kawai et al. | 415/213.1 |
| 7,635,134 | B2 | 12/2009 | Hedley et al. | |
| 7,726,182 | B1 * | 6/2010 | Newlin et al. | 73/116.02 |
| 7,770,292 | B2 | 8/2010 | Stretton | |
| 7,963,542 | B2 * | 6/2011 | Doll et al. | 280/404 |

(Continued)

FOREIGN PATENT DOCUMENTS

CA 2377587 A1 11/2001

*Primary Examiner* — Michael Safavi

(57) ABSTRACT

A stand is disclosed for supporting a moldboard and a drawbar of a grading machine. The stand may comprise a base frame and a component support unit. The said stand may be configured to support the moldboard, and the component support unit may be configured to support at least a portion of the drawbar. The base frame and the component support unit may be configured to: (a) support a substantial portion of the moldboard above the base frame; and (b) support a substantial portion of the drawbar above the base frame and the moldboard when the moldboard is supported on the stand.

19 Claims, 18 Drawing Sheets

(56) References Cited

U.S. PATENT DOCUMENTS

| | | | | |
|---|---|---|---|---|
| 8,336,846 | B2 * | 12/2012 | Fernley et al. | 248/671 |
| 8,827,232 | B2 * | 9/2014 | Crowley | 248/670 |
| 8,851,441 | B2 * | 10/2014 | Acuna et al. | 248/554 |
| 2010/0052288 | A1 * | 3/2010 | Doll et al. | 280/404 |
| 2011/0068548 | A1 * | 3/2011 | Houggard | B65D 85/68 280/43.17 |
| 2013/0134290 | A1 * | 5/2013 | Zhu | 248/678 |

* cited by examiner

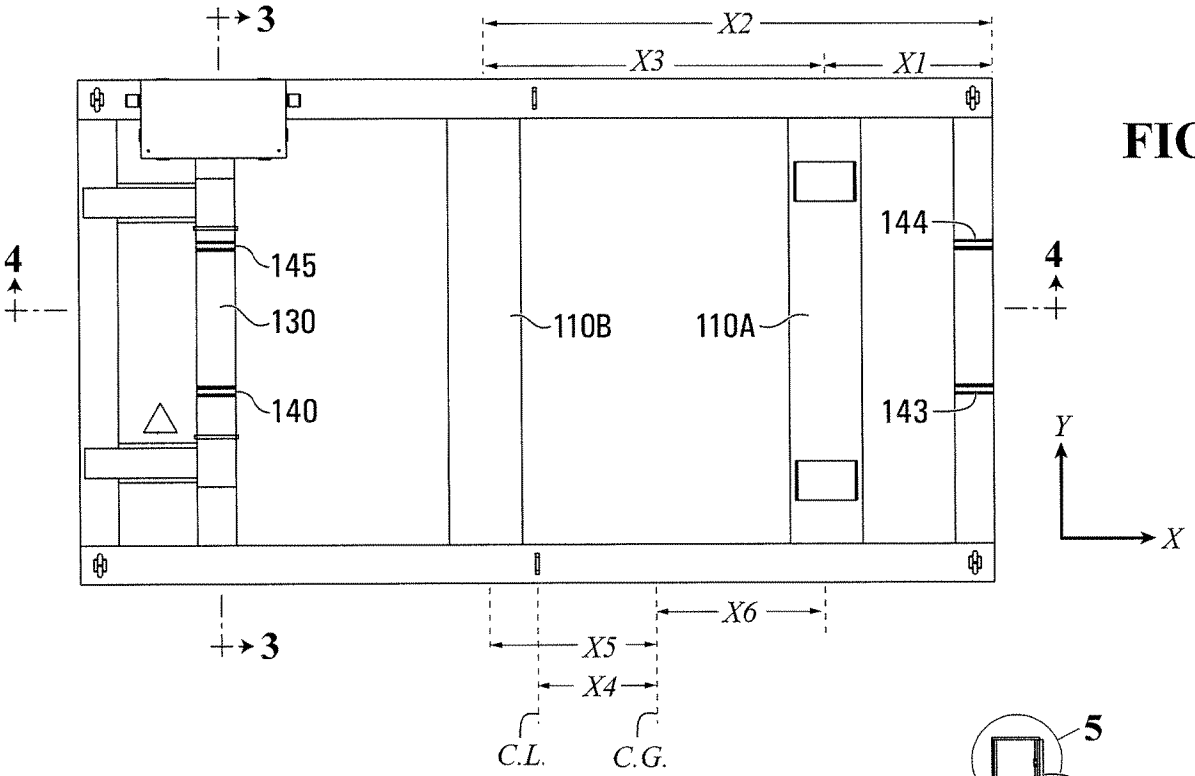
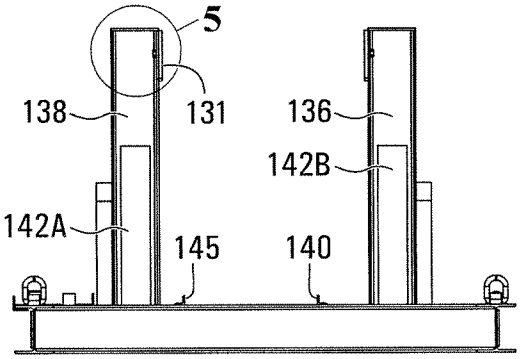
FIG. 3

STAND FOR MACHINE COMPONENTS

CROSS-REFERENCE TO RELATED APPLICATION

This application claims priority from Canadian Patent Application No. 2,820,064 filed Jul. 4, 2013, the contents of which are hereby incorporated herein by reference.

TECHNICAL FIELD

This relates to methods for installing, removing, holding and transporting components of a machine including a grading machine, and related apparatuses.

BACKGROUND

There are many different types of machines used in construction, mining, etc. One such type of machine is a grading machine (often referred to as a "grader" or "motor grader"). One example of a commercially available grading machine is Caterpillar Inc.'s model 24M motor grader. Grading machines are machines typically used for a variety of purposes including for example to level or smooth out a ground surface. Grading machines typically include a main body supported and movable on wheels and powered by an engine. A movable drawbar is typically secured to the main body and a moldboard (also referred to as a blade) is secured to the drawbar. The drawbar may in top view have a large portion that is generally circular in shape and thus these types of drawbars may be referred to as circle drawbars. The drawbar of a grading machine may be secured and mounted for movement including rotation, relative to the main frame of the grading machine. The moldboard may be secured to the drawbar and move with the drawbar. During movement of the grading machine the position and orientation of the drawbar and in particular the moldboard attached thereto, can be selected and adjusted by operation of devices on the grading machine, such as hydraulic cylinders, in order to provide for a desired contour of the surface of the ground over and/or near to which the grading machine travels.

During use, the drawbar and moldboard components of the grading machine are typically subjected to a significant amount of wear and may periodically suffer breakage. Accordingly it will become necessary to service, repair and/or replace the existing drawbar and/or moldboard, or parts thereof.

The drawbar and moldboard are typically very heavy, being made from a material such as a strong metal like a type of steel. They are also large in size and the drawbar in particular is usually of a relatively complex shape. Due to the shape of the drawbar, its center of gravity is not centrally located. Therefore, it is difficult to handle these components during removal from, and installation on, the grading machine. The difficulty in handling such components may cause safety concerns, especially at remote work sites. It is also difficult to transport such components. During service and/or repair of the drawbar and moldboard, a grading machine may be out of service for a considerable period of time.

It is therefore desirable to provide improved methods for holding, installing, removing, servicing/repairing and transporting moldboards and drawbars, and to provide apparatuses relating to the same.

SUMMARY

According to an aspect of the invention there is provided a stand for supporting a moldboard and a drawbar of a grading machine, the stand comprising: i) a base frame; and ii) at least one component support unit; the stand being configured to support the moldboard, and the at least one component support unit being configured to support at least a portion of the drawbar.

According to another aspect of the invention there is provided a method of removing a moldboard and a drawbar from a grading machine and transferring the moldboard and the drawbar to a stand, the method comprising: i) removing the moldboard from connection with the drawbar; ii) transferring the moldboard to the stand; iii) removing the drawbar from the grading machine; and iv) after the moldboard has been transferred to the stand, transferring the drawbar to the stand in longitudinal alignment with the moldboard and in a position wherein a substantial part of the drawbar is positioned above the moldboard.

According to another aspect of the invention there is provided a method of installing a moldboard and a drawbar on a grading machine, the method comprising: i) removing the drawbar from a stand; ii) transferring and connecting the drawbar to the grading machine; iii) removing the moldboard from the stand; iv) after the drawbar has been connected to the grading machine, transferring and connecting the moldboard to the drawbar.

According to another aspect of the invention there is provided a method of servicing a moldboard and a drawbar on a grading machine, the method comprising: i) providing a first stand at a worksite; ii) transferring a first moldboard from the grading machine to the first stand; iii) transferring a first drawbar from the grading machine to the first stand; iv) providing a second stand at a worksite, the second stand having a second moldboard and a second drawbar; v) transferring the second drawbar from the second stand to the grading machine; vi) transferring the second moldboard from the second stand to the grading machine.

Other features will become apparent from the drawings in conjunction with the following description.

BRIEF DESCRIPTION OF THE DRAWINGS

In the figures which illustrate example embodiments,

FIG. 2 is a top view of the stand of FIG. 1;

FIG. 3 is a cross sectional view of a stand across the front support member at line 3-3 as shown in FIG. 2;

DETAILED DESCRIPTION

With reference to FIGS. 1 to 10, a stand 100 for use with components of heavy machinery, and in particular components of a grading machine 125 (see FIG. 12), is illustrated. Stand 100 may comprise a generally rectangular shaped base frame 102. Base frame 102 may include a pair of spaced, generally parallel and longitudinally oriented structural members/beams 104*a*, 104*b* interconnected at their ends to the ends of a pair of spaced, generally parallel and transversely oriented structural members/beams 106*a*, 106*b*. Beams 104*a*, 104*b*, 106*a*, 106*b* may, when interconnected to form a generally rectangular shaped base frame 102, be configured and adapted with additional elements as described hereinafter so as to be capable of supporting grading components that may be loaded onto and from stand 100, and held on stand 100. By way of example only, beams 104*a*, 104*b*, 106*a*, 106*b* may each be I-beams having upper and lower flanges interconnected by a web. For example, beam 104*a* may have a web 105*a*, and beam 104*b* may have a web 105*b*. Beams 104*a*, 104*b*, 106*a*, 106*b* may be made from a suitably strong material such as a type of steel. Beams 104*a*, 104*b*, 106*a*, 106*b* may be fixedly interconnected in any manner such as with nuts and bolts and/or welding.

Extending between longitudinal beams 104*a*, 104*b* may be a pair of spaced, generally parallel and transversely oriented channel members 110*a*, 110*b*. Channel members 110*a*, 110*b* may have a generally rectangular cross section and be configured as generally hollow tubular members. Like beam members 104*a*, 104*b*, 106*a*, 106*b*, channel members 110*a*, 110*b* may be made from a suitably strong material like a suitable steel material and have a suitable wall thickness to be able to withstand the loads applied thereto. Channel member 110*a* may have opposed end portions 108*a*, 109*a*, that extend through slots in the respective web portions 105*a*, 105*b* of longitudinal beams 104*a*, 104*b*. Similarly, channel member 110*b* may have opposed end portions 108*b*, 109*b*, that extend through slots in the respective web portions 105*a*, 105*b* of longitudinal beams 104*a*, 104*b*. Channel members 110*a*, 110*b* may be fixedly interconnected to the longitudinal beams 104, 104*b* in any suitable manner such as with nuts and bolts and/or welding.

Figure 1:
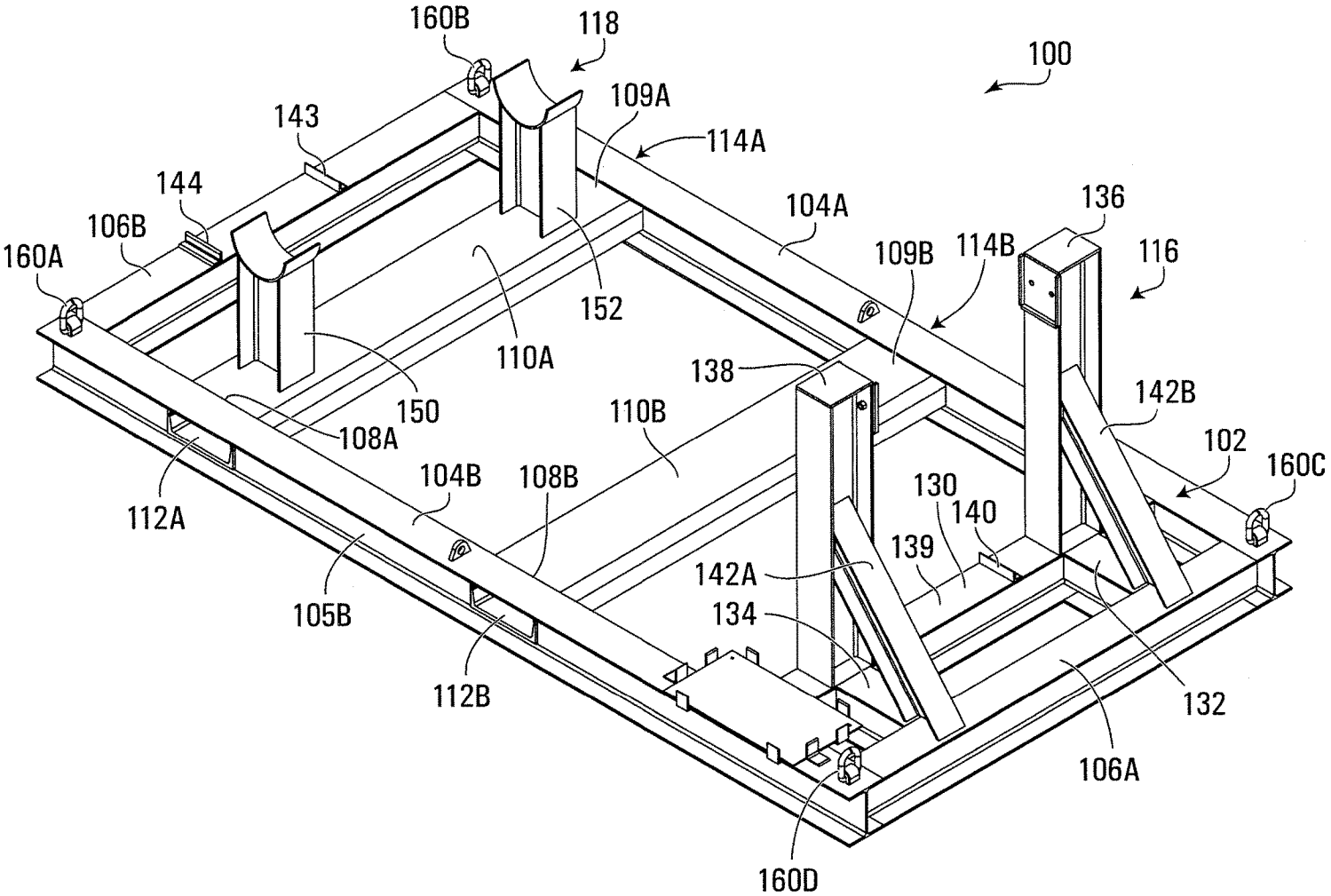
FIG. 1 is an upper front perspective view of a stand.
Figure 4:
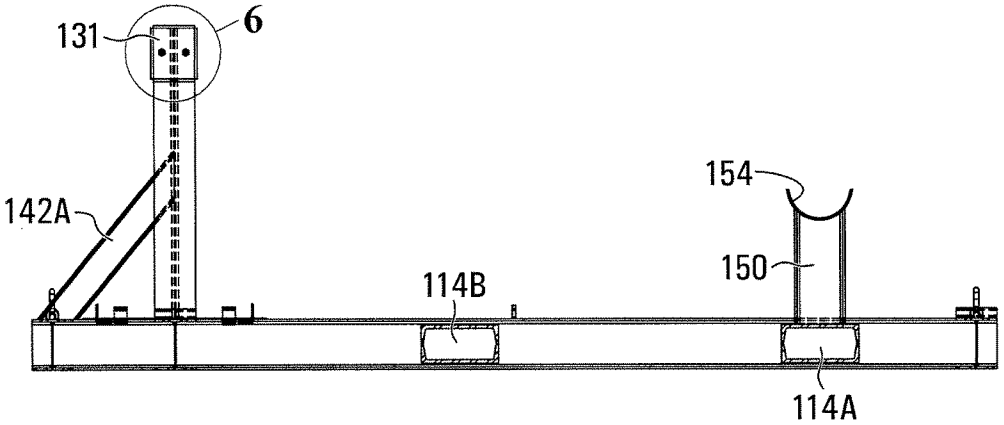
FIG. 4 is a longitudinal cross sectional view of a stand at line 4-4 as shown in FIG. 2.
Figure 6:
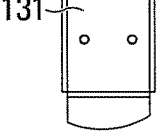
FIGS. 5 and 6 are enlarged views at "5" in FIG. 3 and "6" in FIG. 4 respectively; showing mounting plates attached to the inward facing surfaces of the front posts.
Figure 5:
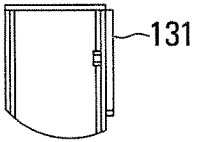
Figure 7:
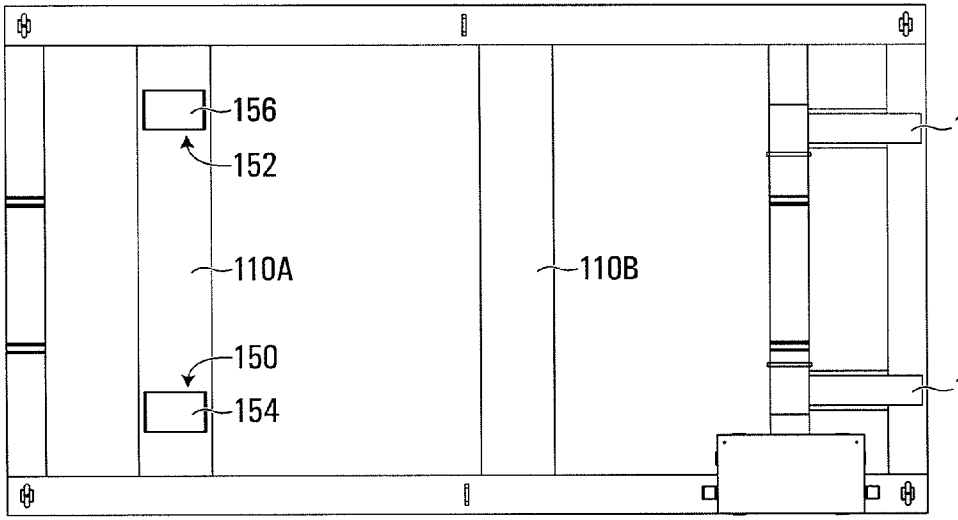
FIG. 7 is another top view of the stand of FIG. 1.
Figure 9:
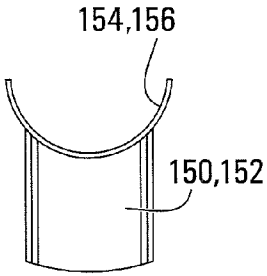
FIG. 9 is an enlarged view at "9" in FIG. 8 showing a half cylinder support member attached to the upper end of a rear post.
Figure 8:
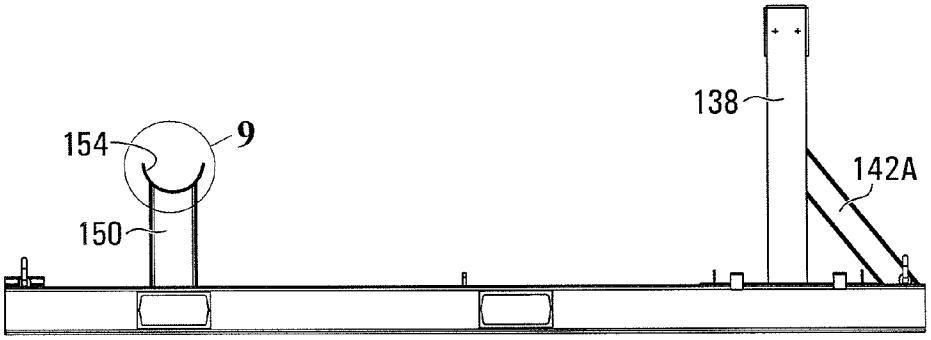
FIG. 8 is a side elevation view of the stand of FIG. 1.
Figure 10:
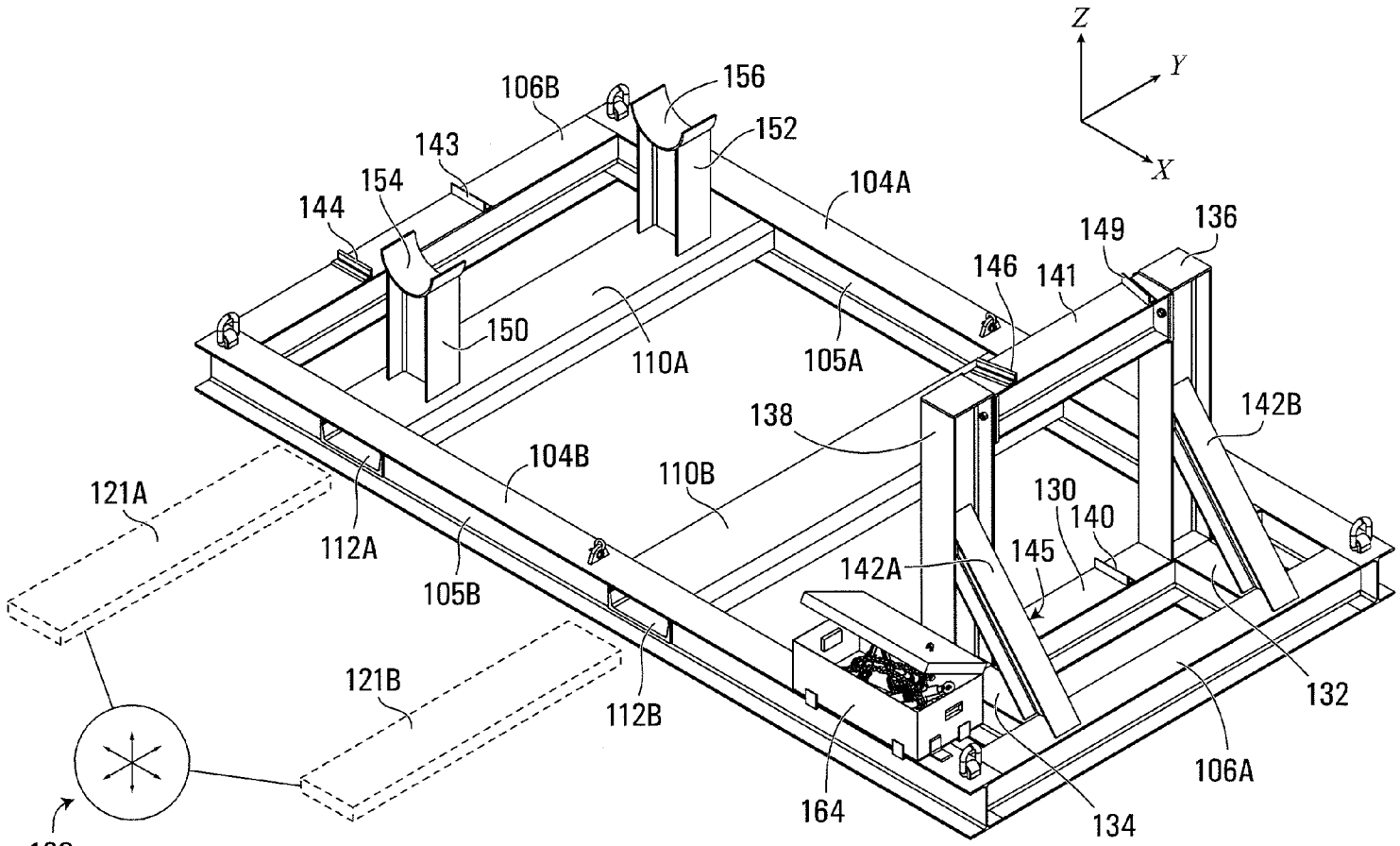
FIG. 10 is an upper front perspective view of the stand of FIG. 1, showing schematically a forklift and forklift blades positioned to engage the transverse channel members of the stand.
Figure 10A:
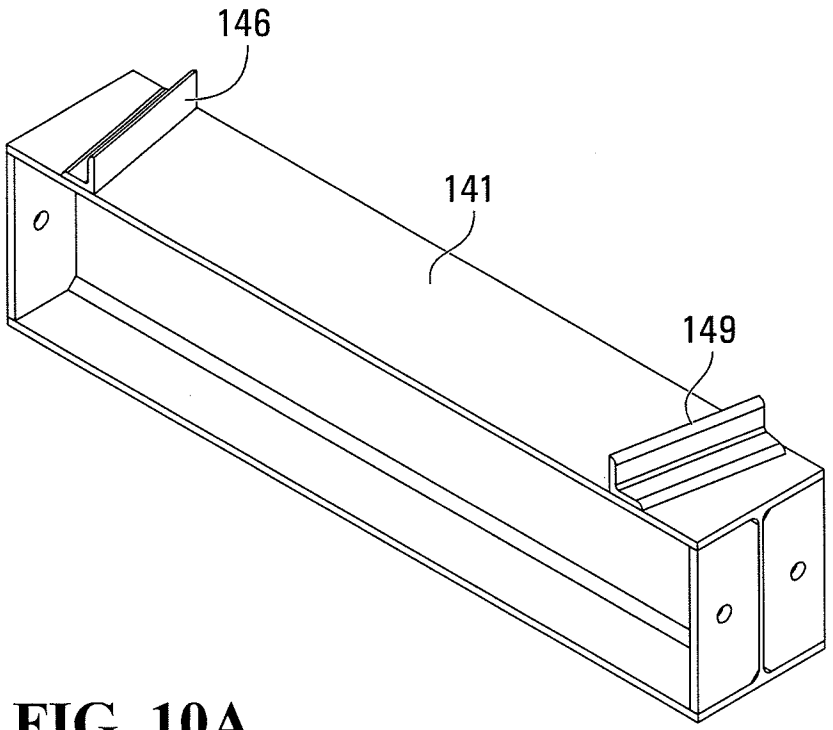
FIG. 10A is an upper perspective view of a front upper support beam which may be attached to mounting plates as shown in FIGS. 5 and 6 attached to front support posts as shown in FIG. 10.

Openings 112*a*, 114*a* may be provided in the respective end portions 108*a*, 109*a*, of channel member 110*a*. Likewise openings 112*b*, 114*b* may be provided in respective end portions 108*b*, 109*b* of channel member 110*b*. With particular reference to FIG. 10, a forklift machine 120 (shown only schematically) may have forklift blades 121*a*, 121*b* that are generally spaced and oriented parallel to each other. Forklift machine 120 may be operable to move the forklift blades together in unison with each other in movements parallel to one or more and preferably all of the mutually orthogonal X, Y and Z axes. Blades 121*a*, 121*b* of forklift 120 may be configured to be able to be received through respective openings 112*a*, 112*b* on one side of stand 100, or through openings 114*a*,114*b* on the opposite side of stand 100 such that the blades may be received in the open channels of the channel members 110*a*, 110*b*. In this way, the blades 121*a*, 121*b* of forklift 120 may be able to engage the channel members 110*a*, 110*b* and thus forklift 120 may be operable to lift stand 100 from contact with a supporting ground surface such that the forklift 120 with forklift blades 121*a*, 121*b* may alone support the stand 100. Forklift 120, while supporting stand 100 on blades 121*a*, 121*b* in channels 110*a*, 100*b* respectively may be able to move stand 100 in movements parallel to any one or more of axes X, Y and Z, or combinations thereof. Openings 112*a*, 112*b* at one end of the channel members 110*a*, 110*b* and openings 114*a*, 114*b* on the other ends of the channel members, and the open channels interconnecting each of the opposed ends, may be "over-sized" both vertically and particularly longitudinally compared to the width of blades 121*a*, 121*b* of the forklift 120. This permits the separation of the blades 121*a*, 121*b* not to have to be precisely the same as the position of the channel openings. Additionally, it allows the longitudinal position of the blades relative to the base frame 102 and the components supported thereon, to be adjusted by a small amount which may assist in suitably positioning the blades relative to the combined center of gravity of the stand and components mounted thereon.

As will be explained further hereinafter, and with particular reference now to FIG. 2, the longitudinal position of the centerlines of each of channel members 110*a*, 110*b* may be selected such that the combined center of gravity CG of the components supported on the stand 100, and of the stand 100 itself, acts at a distance that is approximately half way between the channel members 110*a*, 110*b*. In this way the total load associated with the weight of the components and the stand 100 may be positioned to act such that the blades 121*a*, 121*b*, when received in the channels of channel members 110*a*, 110*b*, carry substantially equal amounts of the load and substantially no torque or moment loads will be applied through the blades 121*a*, 121*b* to forklift 120. In other words the blades 121*a*, 121*b* will be correctly positioned so that the load is substantially balanced and carried substantially equally by the two blades.

Stand 100 may also include a front component retention and support unit generally designated 116 and a rear component retention and support unit generally designated 118. Front support unit 116 and rear support unit 118 may co-operate to support and hold more than one component of a piece of heavy machinery such as a circle drawbar 126 and a moldboard 124 of a grading machine 125 (see FIG. 12).

Front component support unit 116 may include a front cross beam 130. Cross beam 130 may extend between longitudinal beams 104*a*, 104*b* and be generally transversely oriented. Front support unit 116 may also include a pair of generally parallel, longitudinally oriented support members 132, 134 that may extend between cross beam 130 and transverse beam 106*a* of base frame 102. Cross beam 130 and support members 132, 134 may be configured as I-beams and may be made from a suitably strong material like a suitable steel material. Cross beam 130 and support members 132, 134 may be fixedly interconnected together and to transverse beam 106*a* and longitudinal beams 104*a*, 104*b* in any suitable manner such as with nuts and bolts and/or welding.

A pair of spaced, upstanding vertical posts 136, 138 oriented generally parallel to axis Z, may have lower ends fixedly secured to the upper surface of an upper flange 139 of cross beam 130. Posts 136, 138 may be configured as I-beams and may be made from a suitably strong material like a suitable steel material. Posts 136, 138 may be fixedly interconnected to cross beam 130 in any suitable manner such with nuts and bolts and/or welding. An upper releasable support beam 141 may be provided that is oriented generally parallel to and spaced from cross beam 130. Upper support beam 141 may be releasably connected such as with nut and bolts to opposed inward facing surfaces of mounting plates 131 that in turn may be fixedly attached to inward facing surfaces of opposed flanges of posts 136, 138 (see FIGS. 3-6).

Each of posts 136, 138 may also have a support brace member 142*a*, 142*b* respectively that may extend at an angle between its respective post 136, 138 and transverse beam 106*a*. Brace members 142*a*, 142*b* may also be configured as I-beams and may be made from a suitably strong material like a suitable steel material. Each brace member 142*a*, 142*b* may be fixedly interconnected at one end to their respective post and at the opposite end to transverse beam 106*a* in any suitable manner such as with nuts and bolts and/or welding.

The upper surface of top flange of cross beam 130 may, between posts 136, 138 be provided with component guide members 140, 145. Similarly, the upper surface of top flange of removable support beam 141 may, between the top portions of posts 136, 138 be provided with component guide members 146, 149.

Rear support unit 118 may include a pair of spaced, upstanding vertical posts 150, 152 oriented generally parallel to axis Z, and may have lower ends fixedly secured to the upper surface of channel member 110*a*. Posts 150, 152 may also be configured as I-beams and may be made from a suitably strong material like a suitable steel material. Posts 150, 152 may be fixedly interconnected to channel member 110*a* in any suitable manner such as with nuts and bolts and/or welding. The upper end of each post 150, 152 may include a generally half cylinder support member 154, 156 that may each extend between and be securely fixed to, such as with welding and/or nuts and bolts, the central web and the spaced flanges of posts 150, 152 respectively.

Also comprising part of rear component retention unit 118 may be spaced component guide members 143, 144 fixedly secured to the upper surface of the top flange of transverse beam 106*b*. Guide members 143, 144 may be both transversely positioned between posts 154, 156.

Base frame 102 may also include at each of its four corners a ring or tie loop 160*a*, 160*b*, 160*c*, 160*d*. Additionally proximate one front corner of base frame 102 may be a support plate 162 that may be mounted to the upper surfaces of top flanges of beams 104*b* and 106*a* near the interconnection thereof. Support plate 162 may be configured to support a tool box 164 that may be able to hold tools and parts that may be used in connection with the use of stand 100 such as bolts and nuts for use in removing and installing upper support beam 141. Additionally tool box 164 may hold chains and/or cables that may, in conjunction with rings 160*a-d*, be used to secure components of a grading machine 125 to stand 100.

Figure 12:
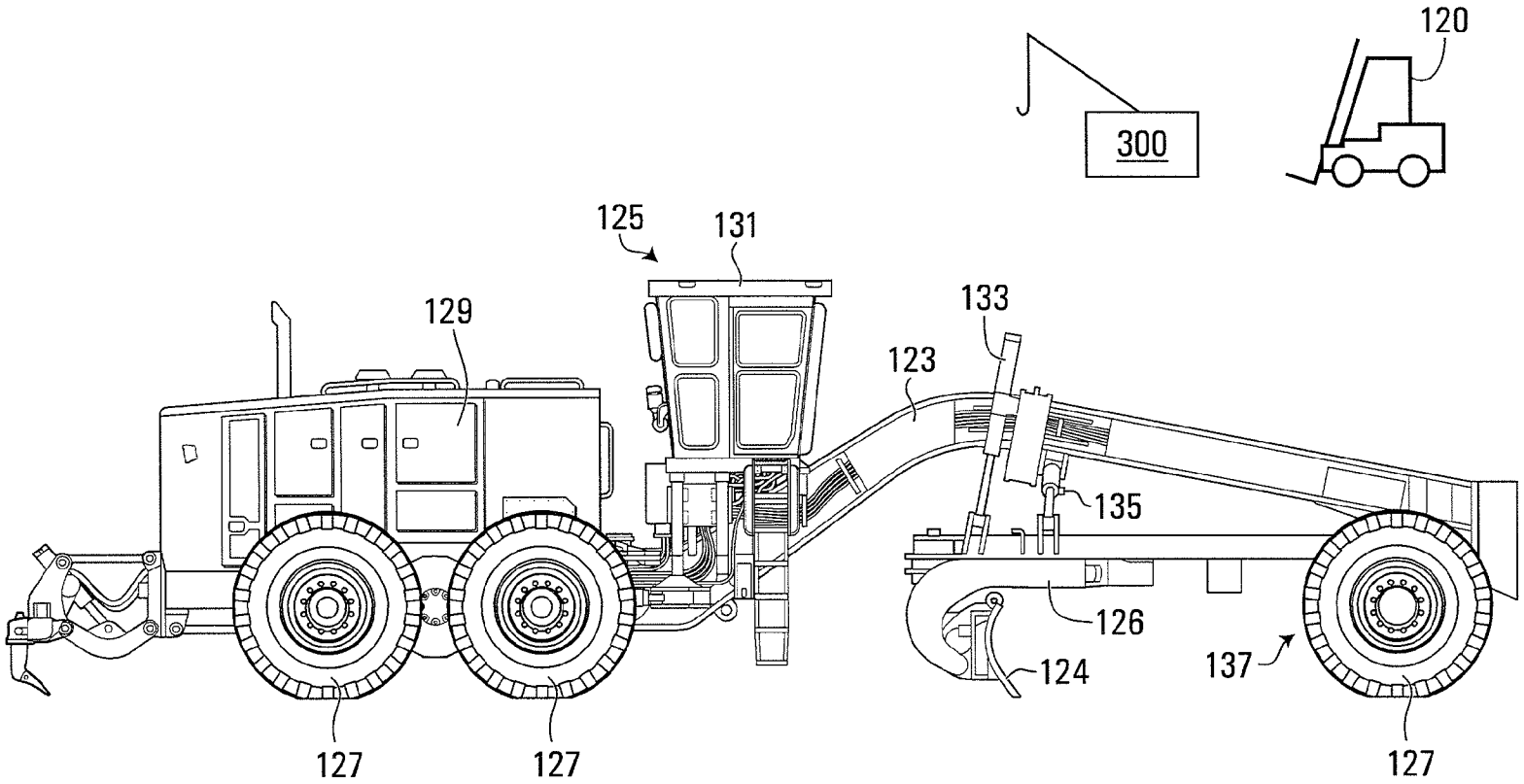
FIG. 12 is a side elevation view of a typical grading machine, such as the Caterpillar model 24M, with drawbar and moldboard attached, along with schematic representations of a forklift and crane that may be used to assist in the removal or installation of a drawbar and moldboard.

With reference now to FIG. 12, a grading machine 125 is illustrated and may for example be a Caterpillar model 24M grading machine made by Caterpillar Inc. Grading machine 125 may include a frame 123 supported on wheels 127 and being driven by a power unit 129. The grading machine 125 may be operated by an operator located in a cab 131. A drawbar 126 may be mounted to the frame 123 about a king pin or ball and socket type pivot 137 and may be supported also by transversely opposed, vertical hydraulic cylinders 133 on each side of the grading machine as well as a transversely oriented hydraulic cylinder 135. Operation of vertical cylinders 133 can cause the drawbar to move up and down and also movement of one cylinder relative to the other can cause rotation of the drawbar about a longitudinal axis of the grading machine 125. Operation of the transverse hydraulic cylinder 135 can cause the drawbar to tend to move transversely inwards towards, and outwards away from, the frame 123.

Figure 13:
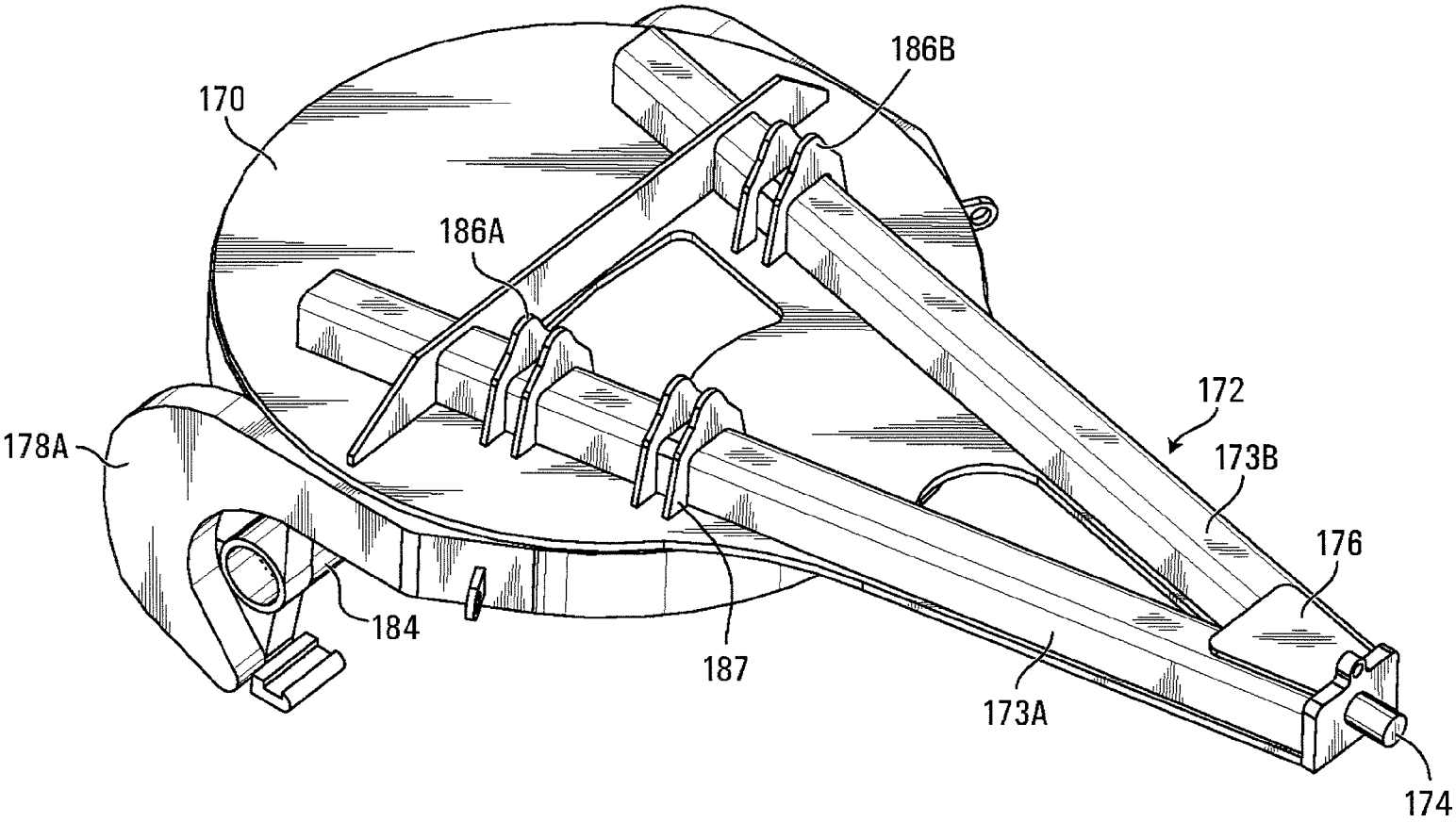
FIG. 13 is an upper perspective schematic view of a typical circle drawbar of a grading machine.
Figure 14:
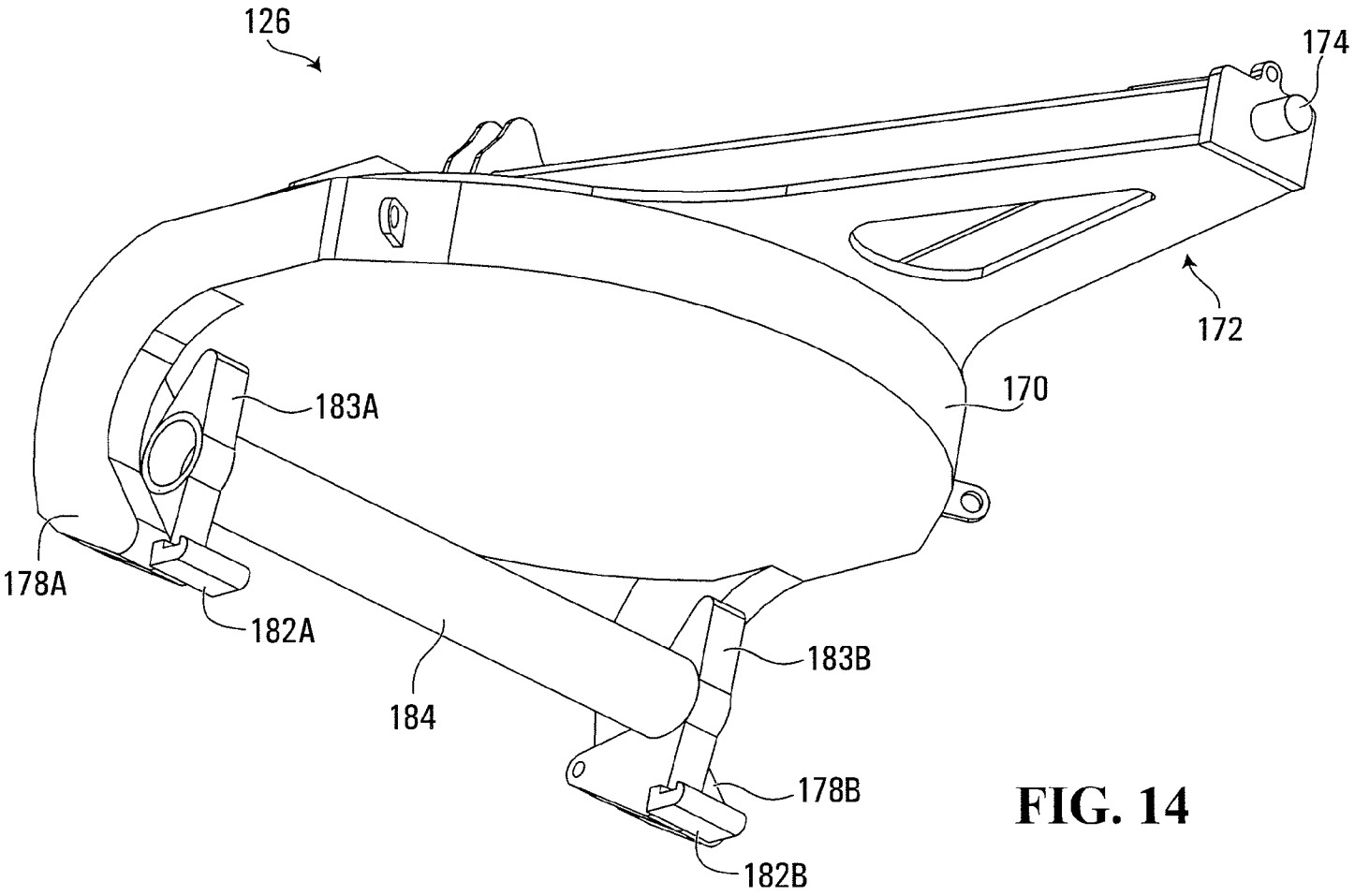
FIG. 14 is a lower perspective view of the drawbar of FIG. 13.

With particular reference to FIGS. 13 and 14, drawbar 126 may include a generally circular shaped disc portion 170 to which may be secured a generally V-shaped support 172. Support 172 may be comprised of a pair of support beams 173*a*, 173*b* angled with respect to each other and joined at an apex 176. A pin 174 may be provided at the apex 176 for interconnecting the drawbar 126 to the pivot 137 of frame 123 of grading machine 125.

Attached to or integrally formed with drawbar disc 170 may be opposed hook portions 178*a*, 178*b* located transversely on either side of drawbar disc 170. Hook portions 178*a*, 178*b* may extend downwards from drawbar disc 170 and assist in creating an attachment area in which moldboard 124 may be mounted to drawbar 126. In this regard, opposed support blocks 183*a*, 183*b* may be attached to inner surfaces of hook portions 178*a*, 178*b* respectively. Extending between support blocks 178*a*, 178*b* may be a support pipe or cylinder 184 which may be generally circular in cross section and may be hollow. Opposed horizontal support plates 182*a*, 182*b* may also be secured to the lower areas of hook portions 178*a*, 178*b* and have upward facing support surfaces. In a known manner, a moldboard 124 may be secured to hook portions 178*a*, 178*b*, support blocks 183*a*, 183*b*, support plates 182*a*, 182*b* and to support cylinder 184. One example of a structure by which a moldboard of a grading machine may be attached to, and disconnected from, a circle drawbar is disclosed in U.S. Pat. No. 4,074,767 issued Feb. 21, 1978 to Cole, the entire content of which is hereby incorporated herein by reference.

As is illustrated in FIG. 13, each of support beams 173*a*, 173*b* of V-shaped support 172 may have a cylinder connection device 186*a*, 186*b* that each enables a piston rod of one of vertical hydraulic cylinders 133 to be interconnected thereto. Additionally, support beam 173*a* may have a cylinder connection device 187 that may be interconnected to the piston rod of transverse hydraulic cylinder 135.

It will be appreciated from the foregoing arrangement, that moldboard 124 may be secured to drawbar 126, and drawbar 126 may be mounted to frame 123. Drawbar 126 with moldboard 124 may be capable of being moved relative to frame 123 of grading machine 125 by operation of hydraulic cylinders 133 and 135.

With reference now to FIGS. 12 to 20 and 22, the use of stand 100 is described when it is desired to remove the moldboard 124 and drawbar 126 from a grading machine 125.

As a first step, an operator of grading machine 125 may maneuver the drawbar 126 using the hydraulic cylinders 133, 135 of the grading machine into a position allowing a worker to access the moldboard 124 to be able to disconnect the moldboard 124 from the drawbar 126. For example an operator may, by selected use of the transverse hydraulic cylinder 135, cause drawbar 126 and moldboard 124 to be moved in a direction generally transversely away from the frame 123 of grading machine 125. A crane or similar apparatus 300 (shown only schematically in FIGS. 12 and 15) may then be positioned above and/or adjacent to the grading machine 125, and a worker may attach cables or chains from the crane to the moldboard 124 in order to assist in removing the moldboard from the grader. The worker may then remove connection elements such as bolts or pins connecting moldboard 124 to drawbar 126, and then release and detach the moldboard 124 and move it away from grading machine 125 using the crane or similar apparatus 300.

With the removable support beam 141 removed from connection to posts 136, 138, moldboard 124 may then be moved with the crane or similar apparatus 300 and placed on stand 100. Moldboard 124 may then be placed in a longitudinal orientation between the left and right front support posts 136, 138 and between the left and right rear support posts 150, 152 (see FIG. 15). Moldboard 124 can be aligned with and between the guides 143, 144 on the transverse beam 106*b* and guides 140, 145 on cross beam 130 of stand 100. Moldboard 124 will then be in place, supported on transverse beam 106*b* and cross beam 130 and laterally restrained by guides 140, 145 and guides 143, 144.

Figure 15:
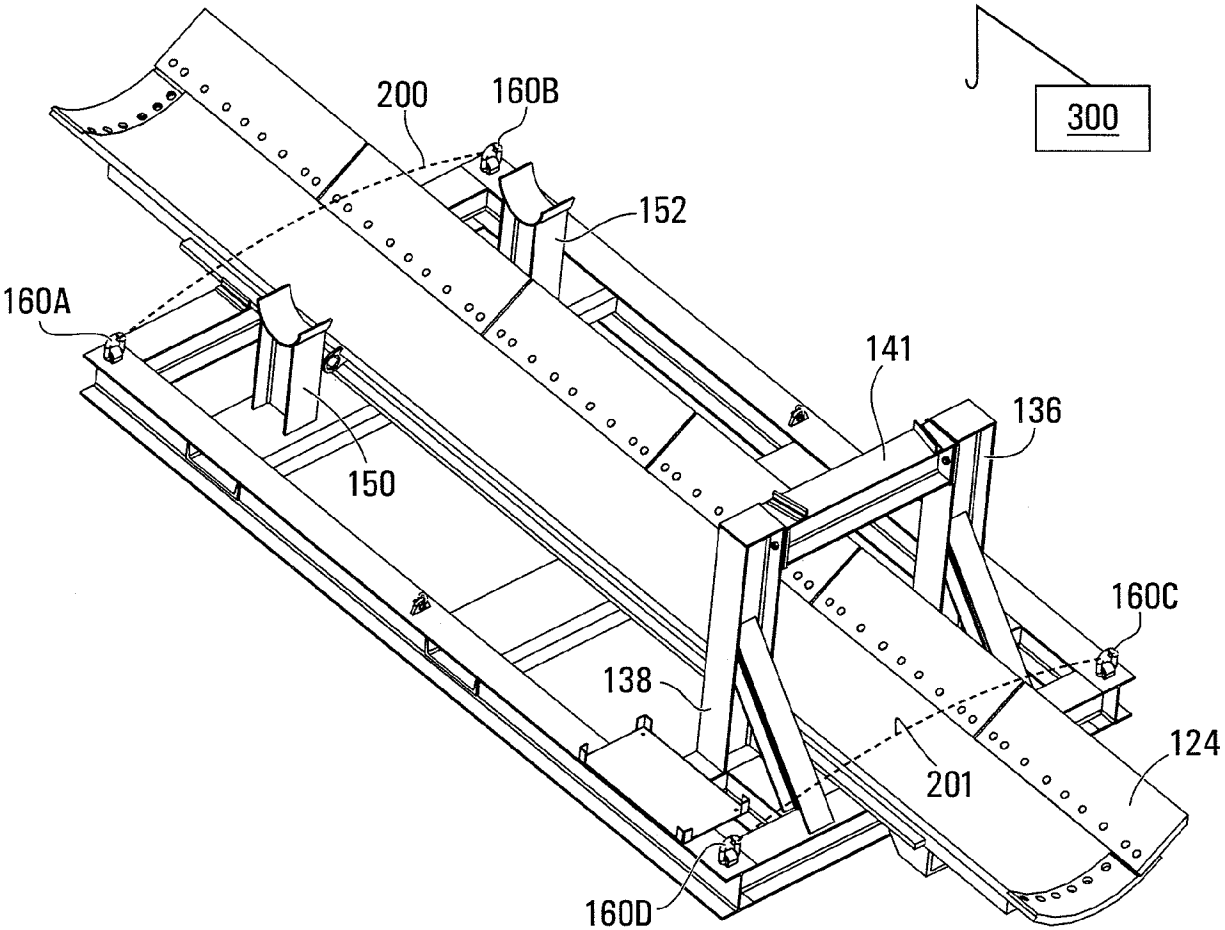
FIG. 15 is an upper perspective view of a stand of FIG. 1 loaded with a moldboard, and showing a schematic of a crane or similar mechanical device that may be used to load a moldboard onto a stand.
Figure 16:
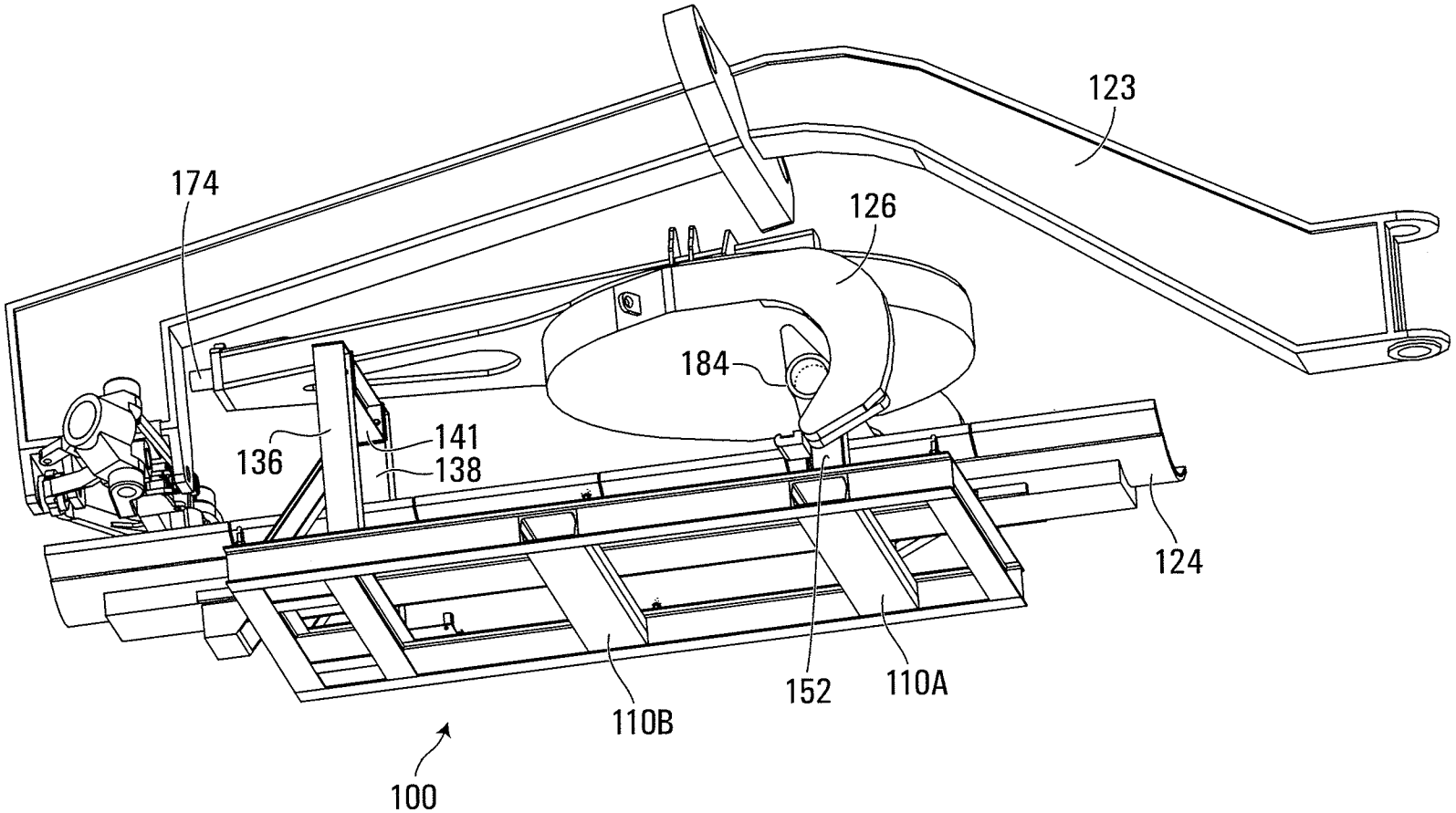
FIG. 16 is a lower perspective view of a stand of FIG. 1 loaded with moldboard and drawbar positioned underneath a frame of a grading machine as it may be aligned during use of a stand.

Once moldboard 124 is in place, it may be secured to stand 100 by chains/cables 200 and 201 which may be engaged with rings 160*a-d* as shown schematically in FIG. 15. Before or after moldboard 124 is secured to stand 100, a worker may re-connect support beam 141 to the front support posts 136, 138 using for example nuts and bolts.

When moldboard 124 is secure, forklift 120 may then be used to engage channel members 110*a*, 110*b* to lift and may maneuver stand 100, (with moldboard 124 secured thereto) into a position underneath the drawbar 126 while it is still attached to frame 123 of grading machine 125. Alternatively, a grader operator may maneuver the grading machine 125 to position grading machine 125 generally above stand 100. Stand 100 may be positioned such that the front support beam 141 is aligned directly under the front beams 173*a*, 173*b* near the apex 176 of the v-shaped support 172 drawbar and with the rear support posts 150, 152 aligned directly under the support cylinder 184 of the drawbar 126.

Figure 11:
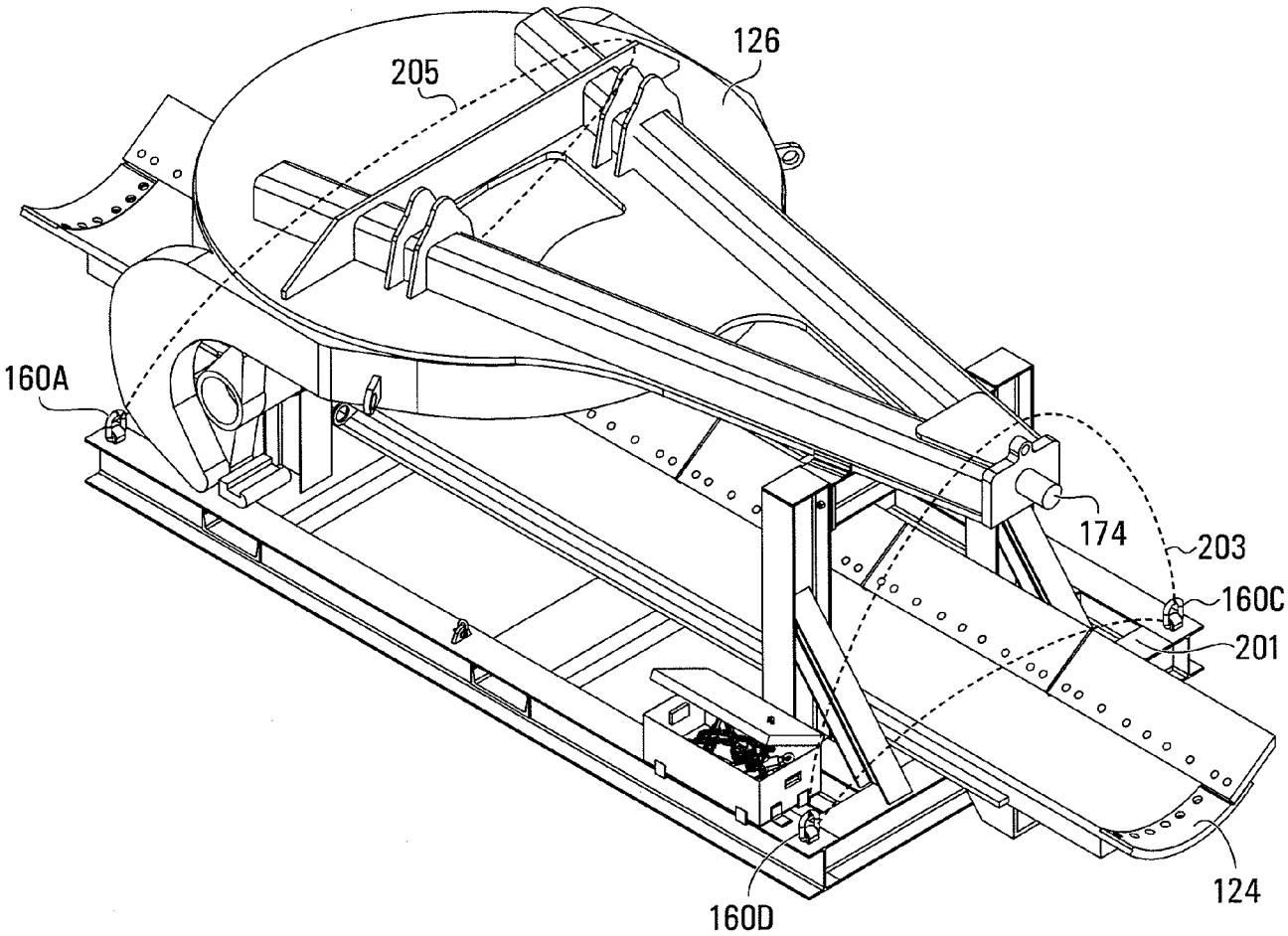
FIG. 11 is an upper perspective view of a stand loaded with a moldboard and circle drawbar, showing where a moldboard and drawbar may be positioned on a stand and showing schematically how a moldboard and drawbar may be secured to a stand using chains or cables.

Once stand 100 is substantially longitudinally and transversely aligned with drawbar 126, forklift 120, with blades 121*a*, 121*b* engaged in channel members 110*a*, 110*b* from one side of stand 100, may be operated to raise stand 100 until the stand is engaged with the drawbar 126 on the mounting locations of the stand 100. Alternatively (or possibly additionally), a grader operator may lower the drawbar 126 onto the mounting locations of the stand 100 using hydraulic cylinders 133, 135. After the drawbar 126 is mounted to and supported by front support beam 141 and support members 154, 156 of posts 150, 152, a worker may disengage the drawbar 126 from the grading machine 125 by disconnecting hydraulic and grease lines (not shown), removing the connection devices such as bolts and pins attaching the pistons of the hydraulic cylinders 133, 135 of the grading machine 125 to cylinder connectors 186*a*, 186*b* on the drawbar 126, and disengaging the enabling pin 174 from pivot 137 to disconnect drawbar 126 from frame 123. The drawbar 126 may then also be secured to stand 100 by attaching chains or cables 203, 205 to the front and rear rings 160*a-d* (see FIG. 11).

Figure 17:
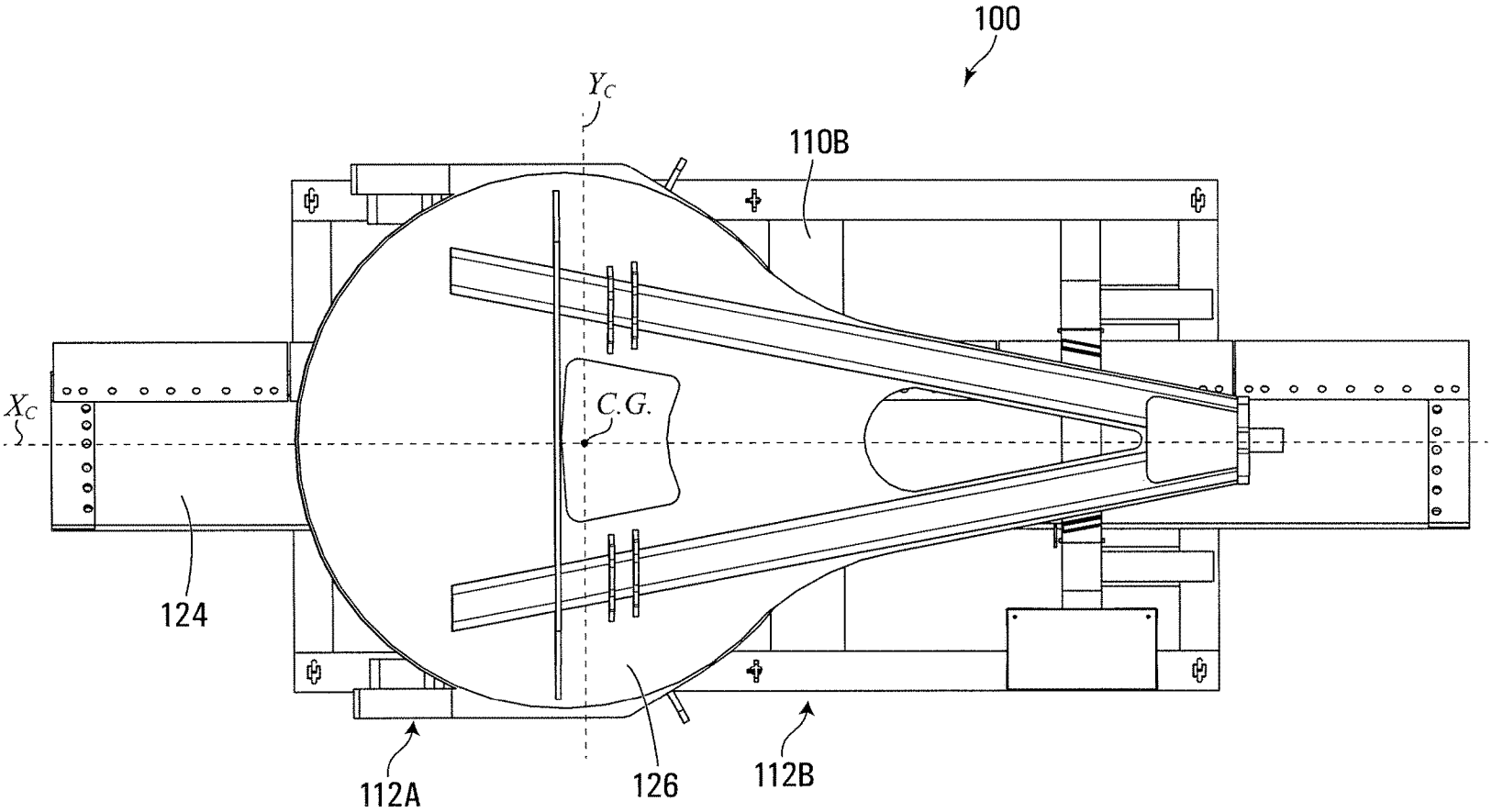
FIG. 17 is a top view of a stand loaded with a moldboard and drawbar, showing the center of gravity of the combined components and the longitudinal and transverse axes of rotation about the center of gravity.
Figure 18:
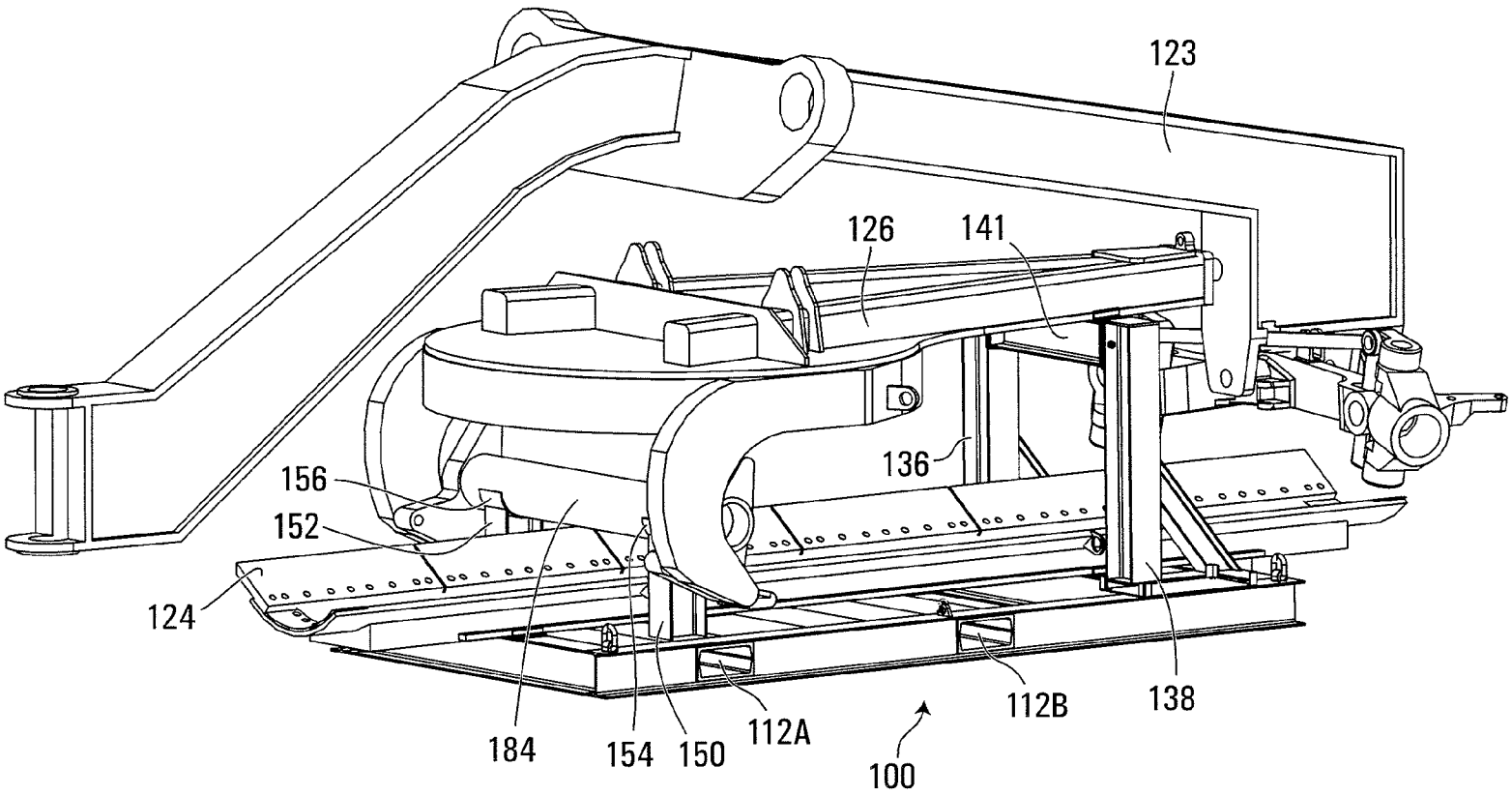
FIG. 18 is a rear perspective view of a stand of FIG. 1 loaded with a moldboard and drawbar, positioned underneath a frame of a grading machine as it may be aligned during use of the stand.
Figure 19:
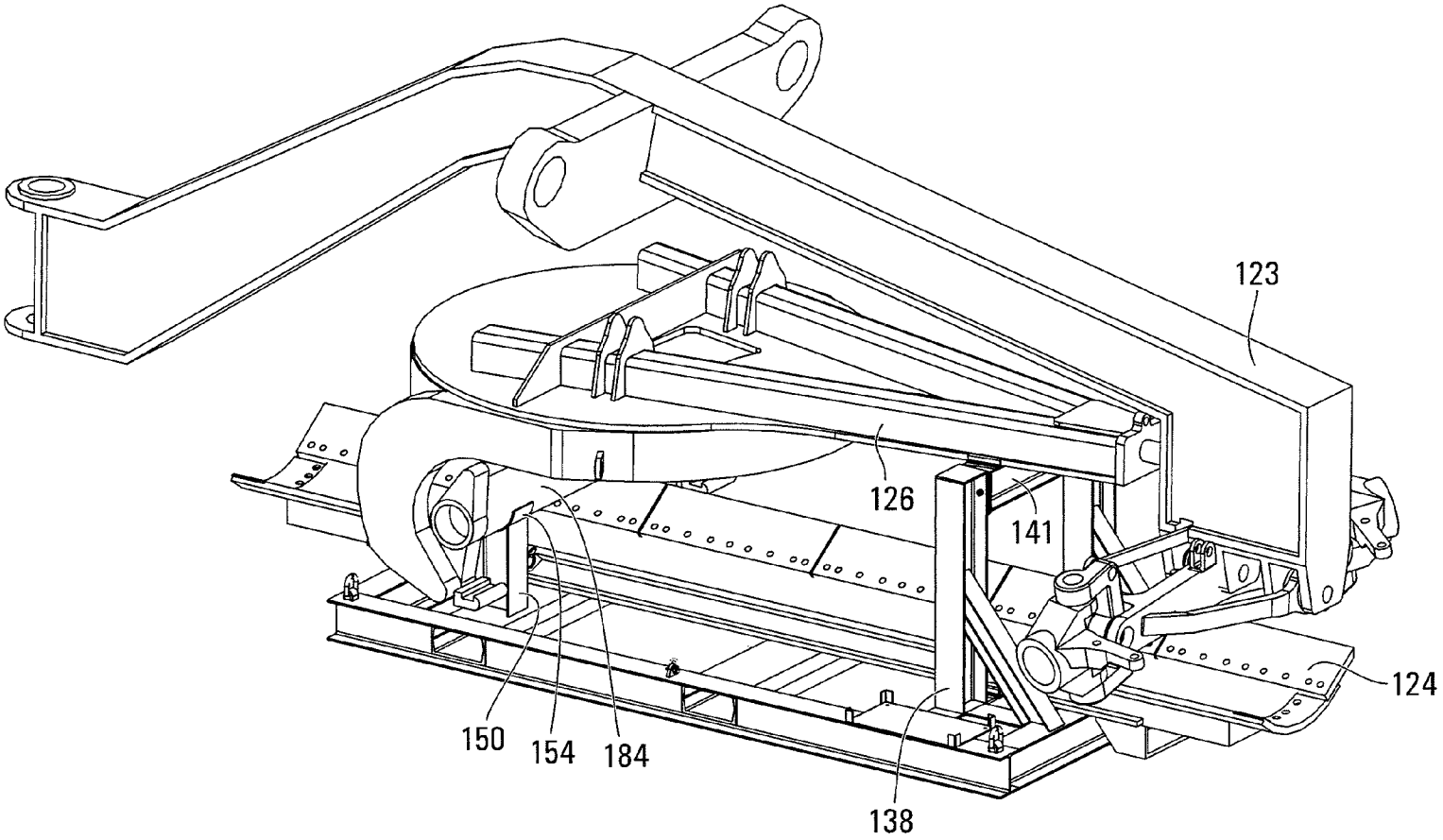
FIG. 19 is an upper perspective view of a stand loaded with a moldboard and drawbar, positioned underneath a frame of a grading machine as it would be aligned during use of a stand.
Figure 20:
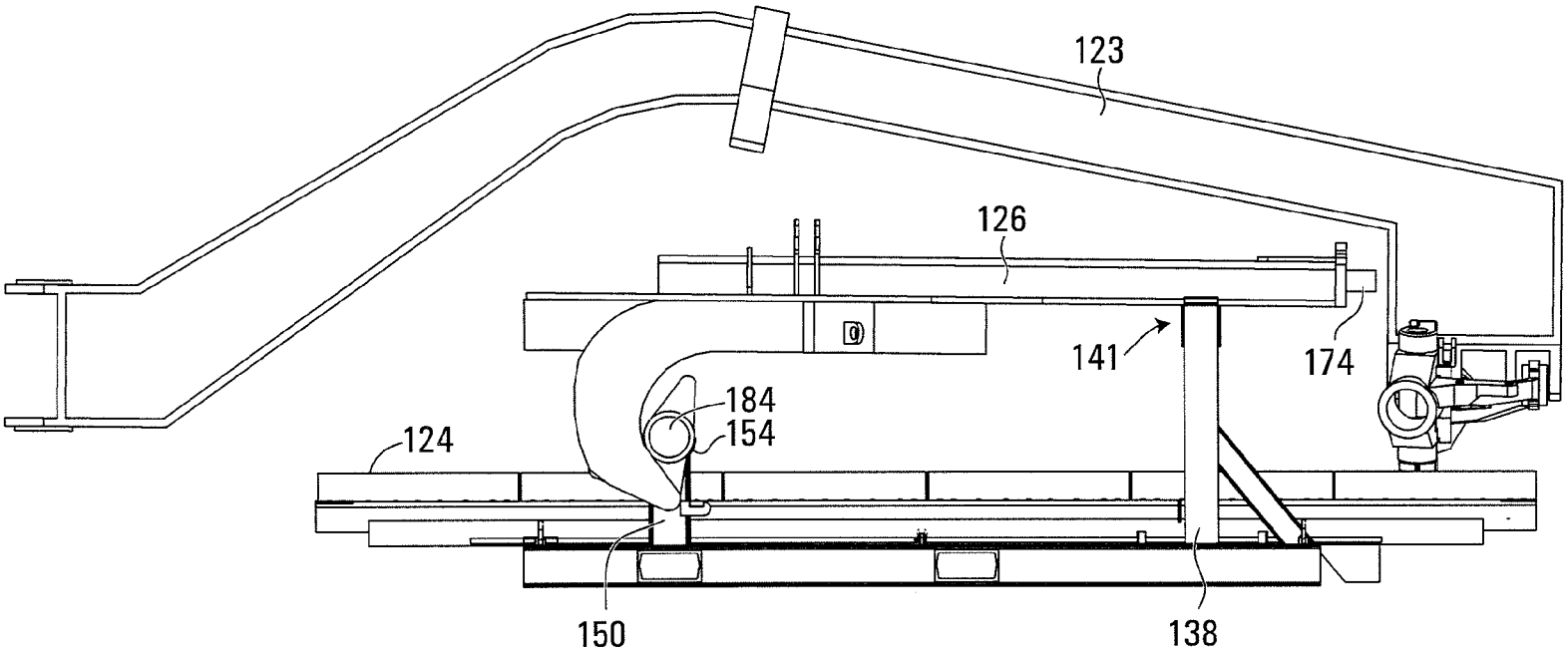
FIG. 20 is a side elevation view of a stand loaded with a moldboard and drawbar, positioned underneath a frame of a grading machine as it would be aligned during normal use of a stand.

With the drawbar 126 detached from frame 123 of grading machine 125, forklift 120 may move stand 100 with drawbar 126 and moldboard 124 securely attached thereto. With reference to FIG. 17, stand 100, moldboard 124 and drawbar 126 are generally all substantially symmetrical about a longitudinal central axis Xc passing though the combined Center of Gravity (CG) of the stand 100, moldboard 124 and circle drawbar 126. It should be noted that the precise location of the combined Center of Gravity CG can be determined using computer aided design software such as SolidWorks and other commercially available software tools. As such, the combined weight of stand 100, moldboard 124 and drawbar 126 will provide little if any torque about the central longitudinal axis Xc. Any relatively small amounts of torque about such an axis will be easily resisted by the blades 121*a*, 121*b* of forklift 120. Thus stand 100 with moldboard 124 and drawbar 126 attached thereto will be stable and substantially balanced about the central longitudinal axis Xc. By contrast, there is no transverse line of symmetry of the combined stand 100, moldboard 124 and drawbar 126 due to the complex geometry of the combined components. It will be appreciated that the combined CG of the loaded stand 100 may not lie along the transverse centerline of base frame 102 (see FIG. 2). To facilitate the handling of the resultant load applied by the combined weight of stand 100, moldboard 124 and drawbar 126, the position of the channel members 110*a*, 110*b* may be chosen such that the combined CG is located approximately half way between the channel members 110*a*, 110*b* (i.e. such that the distances X5 and X6 between the CG and the transverse centerline of channel members 110*a*, 110*b* are substantially equal). In such an embodiment, the load carried by blades 121*a* and 121*b* of forklift 120 will be substantially equal, and therefore there will be substantially no torque or moment being applied to the blades 121*a*, 121*b* about a transverse axis Yc passing through the CG. As can be seen from FIG. 2 the CG is longitudinally positioned a distance X4 from the transverse centerline of the base frame 102. Thus, for any particular configuration of stand 100, moldboard 124 and drawbar 126, the longitudinal positions of the channel members 110*a*, 110*b* can be appropriately selected in order to enhance the overall stability and balance of the load when it is being lifted and moved by a forklift 120. The enhanced stability may provide increased safety when handling the moldboard 124 and drawbar 126 when supported on stand 100. It should be noted that even though the channels will not therefore be appropriately positioned relative to the combined center of gravity when only one component is loaded (i.e. the moldboard 124), this is not such a concern because the weight of the moldboard is significantly less than the combined weight of the drawbar and moldboard and the forklift can compensate for the relative imbalance when just lifting the moldboard 124.

As an alternative to employing forklift 120, an operator may move the grading machine 125 away from stand 100 and the stand may be moved using a crane or similar apparatus.

Stand 100 with drawbar 126 and moldboard 124 secured thereto, may together be placed on a flatbed truck or similar vehicle for transportation, or may be moved to a convenient location for servicing.

To install a new or replacement drawbar 126 and moldboard 124 using stand 100, the process for removal is substantially reversed.

A drawbar 126 and moldboard 124 on a stand 100 may be provided, and then may be transported to a work site on a flatbed truck or similar vehicle. A worker may move the stand 100 with moldboard 124 and drawbar 126 secured thereto attached using a forklift 120, or alternatively using a crane or picker.

The loaded stand 100 may be positioned under grading machine 125 using a forklift 120 such that the front pin 174 of the drawbar 126 is positioned near the corresponding mounting pivot 137 on frame 123 of grading machine 125. Stand 100 may be positioned under the grading machine, and a worker may remove any chains or cables 203, 205 securing the drawbar 126 to stand 100. A worker may then attach the drawbar 126 to the frame 123 of grading machine 125 by attaching the front pin 174 to the pivot 137, connecting the piston rods of the hydraulic cylinders 133, 135, as well as connecting the hydraulic and grease lines (not shown) to the corresponding mounting points on the drawbar 126. When the drawbar 126 has been installed, an operator of grading machine 125 may lift the drawbar from the stand 100 using the controls for the hydraulic cylinders 133, 135.

With drawbar 126 having been removed from stand 100, the stand with moldboard 124 still secured thereto may be moved from under the grading machine 125 using forklift 120. Alternatively, a grader operator may move the grading machine 125 away from stand 100.

To install the moldboard 124, first any chains or cables 200, 201 securing the moldboard 124 to stand 100 would be released and removed. Also, possibly before or after the chains/cables 200, 201 are removed, the front support beam 141 can be detached from the front support posts 136, 138 by removing the nuts and bolts attaching the beam 141 to the posts. Moldboard 124 may then be lifted clear of the stand 100 using a crane or picker or similar machine 300 and can be positioned near the moldboard mounting location at the rear of drawbar 126. When moldboard 124 is in the correct position, a worker may attach moldboard 124 to drawbar 126 by aligning the moldboard with the guide rails on the drawbar 126 and then attaching the corresponding bolts or pins to the mounting locations on the drawbar.

Once the drawbar 126 and moldboard 124 are installed on the grading machine, the stand 100 may be moved away from the work area using a forklift, crane, or similar machine.

Figure 21:
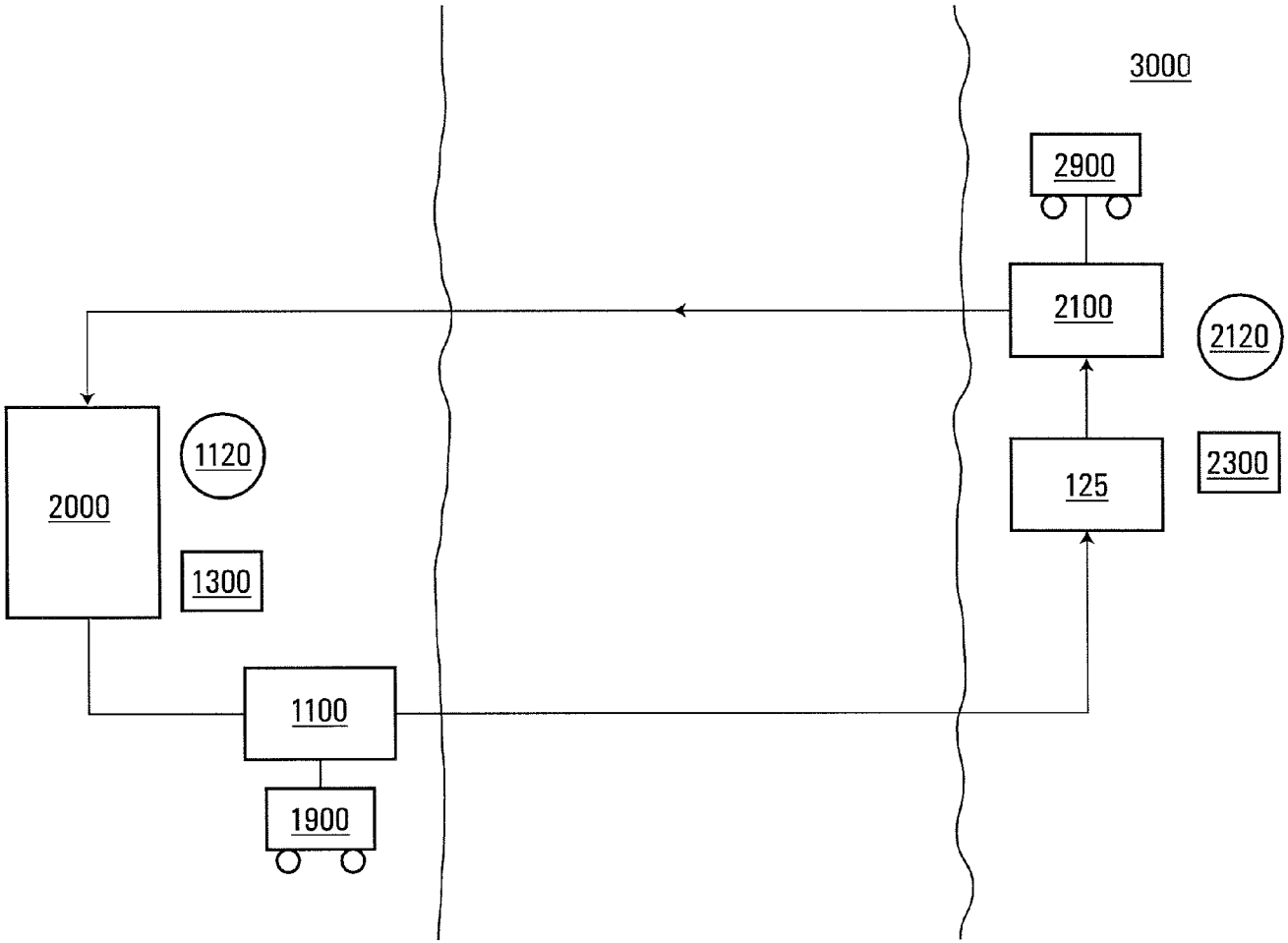
FIG. 21 is a schematic representation of an example method of servicing a motor grader utilizing two stands, showing how the two stands may be used in conjunction with forklifts, cranes, and flatbed trucks to transport grading machine parts between a workshop and a remote work site.
Figure 22:
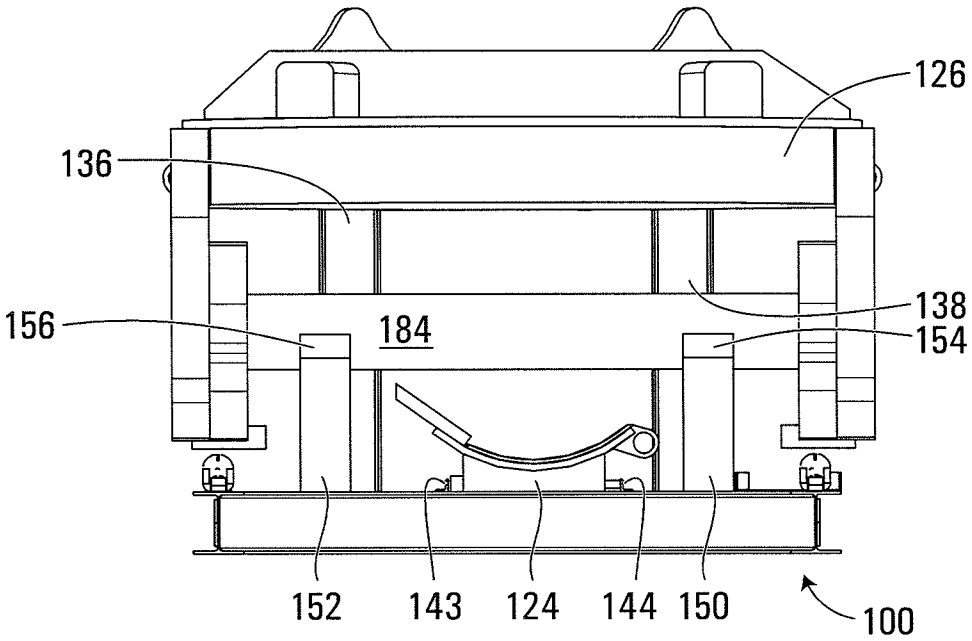
FIG. 22 is an end view of the stand of FIG. 1 loaded with a moldboard and drawbar.

With reference now to FIG. 21 an example method of servicing a grading machine 125 is illustrated utilizing two stands 1100 and 2100, each stand which may be constructed like stand 100 as referenced above. A workshop 2000 may be provided at a distant location from a work site 3000. At workshop 2000 a forklift 1120 and a crane 1300 may be provided. Similarly at work site 3000 a forklift 2120 and crane 2300 may be provided. Forklifts 1120 and 2120 may be configured and utilized with stands 1100 and 2100 and grading machine 125 like forklift 120 is configured and used with stand 100 and grading machine 125 as described above. Similarly, cranes 1300 and 2300 may be configured and utilized with stands 1100 and 2100 and grading machine 125 like forklift 120 is configured and used with stand 100 and grading machine 125 as described above.

When grading machine 125 at work site 3000 requires its moldboard and drawbar to be serviced/repaired, stand 2100 may be employed along with forklift 2120 and crane 2300 to remove the moldboard and drawbar as described above. Then stand 2100, loaded with the moldboard and drawbar requiring service may be loaded onto a transportation vehicle such as a flatbed truck 2900 and then the stand may be transported to the workshop 2000 for servicing/repair. At workshop 2000 forklift 1120 and crane 1300 may be used to unload the moldboard and drawbar from the truck 2900 and from stand 2100. So that the grading machine 125 is not out of service for an extended period of time, the other stand 1100 loaded with a replacement moldboard and drawbar may be transported by a transportation vehicle such as a flatbed truck 1900 from workshop 2000 to the work site 3000. At worksite 3000, forklift 2120 and crane 2300 may be used to unload the stand 2100 from the truck 2900 and the replacement moldboard and drawbar from stand 2100 and connect them to the grading machine 125.

Stands 1100 and 2100, being of substantially similar construction as described above, may be used interchangeably at workshop 2000 and worksite 3000. For example, once the replacement moldboard and drawbar have been delivered to worksite 3000 using stand 1100 and the moldboard and drawbar to be serviced have been delivered to workshop 2000 using stand 2100, stand 2100 may later be used to transport a new or serviced moldboard and drawbar from workshop 2000 to worksite 3000 and stand 1100 may be used to transport a used moldboard and drawbar for servicing from worksite 3000 to workshop 2000. In this manner, two or more stands may be used in combination to minimize downtime of grading machine 125 caused by the need to service and/or replace the moldboard and drawbar.

Of course, the above described embodiments are intended to be illustrative only and in no way limiting. The described embodiments of carrying out the invention are susceptible to many modifications of form, arrangement of parts, details and order of operation. Other modifications will be apparent to those skilled in the art and, therefore, the invention is defined in the claims.

When introducing elements of the present invention or the embodiments thereof, the articles "a," "an," "the," and "said" are intended to mean that there are one or more of the elements. The terms "comprising," "including," and "having" are intended to be inclusive and mean that there may be additional elements other than the listed elements.

What is claimed is:

1. A stand for supporting a moldboard and a drawbar, said stand comprising:

a. a base frame;

b. a first component support unit;

c. a second component support unit;

said stand being configured to support said drawbar and said moldboard in a generally longitudinal orientation;

said first and second support units being configured to support at least a portion of said drawbar above said moldboard when said moldboard and said drawbar are supported on said stand;

said first component support unit comprises transversely spaced first and second support structures upstanding from said base frame and a transversely oriented support member extending between said first and second support structures; and said support member and said first support structure and said second support structure being adapted such that said support member is operable to being removed from, and installed in, an operational configuration for supporting said drawbar at a first location; and wherein said frame, said first and second structures and said support member are configured and positioned such that said drawbar can be at least partially supported on said support member at a position in which at least a portion of said drawbar is above at least a portion of said moldbar, when said support member is connected to said first and second support structures, wherein said drawbar has a transversely oriented support member having a generally cylindrical outer surface; and wherein said second component support unit comprises transversely spaced third and fourth support structures upstanding from said base frame, said third and fourth support structures being longitudinally spaced from said first and second support structures, and said third and fourth support structures each having upwardly directed curved support surfaces, said curved support surfaces being configured to, in operation, engage with portions of the generally cylindrical outer surface of the transversely oriented support member to at least partially support said drawbar.

2. A stand for supporting a moldboard and a drawbar of a grading machine, said stand comprising:

i) a base frame; and ii) at least one component support unit;

said stand being configured to support said moldboard, and said at least one component support unit being configured to support at least a portion of said drawbar;

wherein said base frame and said at least on component support unit are configured and operable to: (a) support a substantial portion of said moldboard in above said base frame; and (b) support a substantial portion of said drawbar above said base frame and said moldboard when said moldboard is supported on said stand; wherein said at least one component support unit comprises:

iii) a first component support unit;

iv) a second component support unit located in spaced longitudinal relation to said first support unit;

wherein said base frame and said first and second component support units are configured to support a longitudinally extending moldboard in a generally longitudinal orientation relative to said base frame;

wherein said first support unit comprises a pair of transversely spaced posts interconnected by a transversely oriented support beam, said support beam operable to support a portion of said drawbar; wherein said transversely oriented support beam is adapted to being removed from, and installed in, an operational configuration for supporting said at least a portion of said drawbar.

3. A stand as claimed in claim 2 wherein said base frame and said at least one component support unit are configured such that said moldboard can be at least partially supported at an upper surface of base frame.

4. A stand as claimed in claim 2 wherein said base frame is substantially rectangular in shape and said at least one component support unit is interconnected to said base frame.

5. A stand as claimed in claim 2 wherein said at least one component support unit comprises:

i) said first component support unit;

ii) a second component support unit located in spaced longitudinal relation to said first support unit;

wherein said base frame and said first and second component support units are configured to support a longitudinally extending moldboard in a generally longitudinal orientation relative to said base frame.

6. A stand as claimed in claim 5 wherein:

i) said first support unit comprises said pair of spaced posts comprising first pair of transversely spaced posts upstanding from said base frame;

ii) a second support unit comprises a second pair of transversely spaced posts upstanding from said base frame located in spaced longitudinal relation to said first pair of posts;

wherein said first and second pairs of posts are configured to position a moldboard in a generally longitudinal orientation relative to said base frame between the pair of posts in each of said first and second pairs of posts.

7. A stand as claimed in claim 5 wherein said first component support unit comprises a first drawbar support and said second component support unit comprises a second drawbar support longitudinally spaced from said first drawbar support, wherein said first and second drawbar supports are configured and operable to support a substantial portion of said drawbar above said moldboard when supported by said first and second support units in a generally longitudinal orientation relative to said base frame.

8. A stand as claimed in claim 6 wherein said first component support unit further comprises a first drawbar support and said second support unit further comprises a second drawbar support longitudinally spaced from said first drawbar support, wherein said first and second draw bar support are configured and operable to support said substantial portion of said drawbar above said moldboard when supported by said first and second support units in a generally longitudinal orientation relative to said base frame.

9. A stand as claimed in claim 8 wherein said first drawbar support comprises a transversely oriented support beam connected to and extending between said first pair of posts, said support beam being operable to support a portion of said drawbar, such that said drawbar is at least in part supported by and between said first and second component support units.

10. A stand as claimed in claim 9 wherein said second drawbar support comprises said second pair of transversely spaced posts each having a partially cylindrical support operable to engage a transversely oriented support cylinder of said drawbar.

11. A stand as claimed in claim 10 wherein said first support unit further comprises a first pair of transversely spaced guides operable to assist in retaining said moldboard.

12. A stand as claimed in claim 11 wherein said second support unit further comprises a second pair of transversely spaced guides operable to assist in retaining said moldboard, said second pair of guides being longitudinally spaced from said first pair of guides.

13. A stand as claimed in claim 2 wherein said stand further comprises first and second spaced and transversely oriented forklift channels, said forklift channels being configured to be able to receive therein first and second blades of a forklift to enable a forklift to be able to lift said stand.

14. A stand as claimed in claim 13 wherein said first and second spaced and transversely oriented forklift channels are longitudinally positioned on opposite sides of the combined center of gravity of said stand, said moldboard and said drawbar, when said moldboard and said drawbar are loaded on said stand to provide a stable support for said stand loaded with said moldboard and said drawbar.

15. A stand as claimed in claim 5 wherein said stand further comprises first and second spaced and transversely oriented forklift channels, said forklift channels being configured to be able to receive therein first and second blades of a forklift to enable a forklift to be able to lift said stand.

16. A stand as claimed in claim 15 wherein said first and second spaced and transversely oriented forklift channels are longitudinally positioned on opposite sides of the combined center of gravity of said stand, said moldboard and said drawbar, when said moldboard and said drawbar are mounted on said stand to provide a stable support for said stand loaded with said moldboard and said drawbar.

17. A stand as claimed in claim 2 wherein said first support unit further comprises a first pair of transversely spaced guides operable to assist in retaining said moldboard.

18. A stand as claimed in claim 17 wherein said second support unit further comprises a second pair of transversely spaced guides operable to assist in retaining said moldboard, said second pair of guides being longitudinally spaced from said first pair of guides.

19. A stand as claimed in claim 2 wherein said base frame and said at least one component support unit are configured: (a) to support a substantial portion of said moldboard above said base frame; and (b) such that a drawbar can be loaded onto said stand from above said stand and said moldboard such that a substantial portion of said drawbar is located above said base frame and said moldboard when said moldboard is supported on said stand.

* * * * *